US005405124A

United States Patent [19]

Mayer et al.

[11] Patent Number: 5,405,124

[45] Date of Patent: Apr. 11, 1995

[54] C-SHAPED CLAMP

[75] Inventors: Theodor Mayer, Bietigheim-Bissingen; Horst Klimach, Ilsfeld, both of Germany

[73] Assignee: Bessey & Sohm GmbH & Co., Bietigheim-Bissingen, Germany

[21] Appl. No.: 140,725

[22] Filed: Oct. 21, 1993

[30] Foreign Application Priority Data

Oct. 24, 1992 [DE] Germany ..... 42 36 049.8

[51] Int. Cl.[6] ..... B25B 1/20

[52] U.S. Cl. ..... 269/45; 269/249; 269/152; 269/155; 269/287; 269/88

[58] Field of Search ..... 269/45, 166–167, 269/249, 152–155, 97, 98, 287, 100, 170; 81/436

[56] References Cited

U.S. PATENT DOCUMENTS

| | | | |
|---|---|---|---|
| 827,612 | 7/1906 | Broadbooks | 269/166 |
| 1,306,858 | 6/1919 | Salter | 269/45 |
| 2,061,217 | 11/1936 | Watcher | 269/170 |
| 2,324,803 | 7/1943 | Snyder | 269/152 |
| 2,606,583 | 8/1952 | O'Connor | 269/249 |
| 3,626,497 | 12/1971 | Lambert | 269/249 |
| 3,913,903 | 10/1975 | Seward et al. | 269/100 |
| 4,500,077 | 2/1985 | Coxon | 269/45 |
| 4,503,737 | 3/1985 | DiGiovanni | 81/436 |
| 4,582,307 | 4/1986 | Wang | 269/249 |
| 4,607,829 | 8/1986 | Suska | 269/152 |

*Primary Examiner*—Robert C. Watson
*Attorney, Agent, or Firm*—Barry R. Lipsitz

[57] ABSTRACT

In order to provide a C-shaped clamp for clamping workpieces, comprising a C-shaped clamp bow, a spindle nut arranged at one end of the clamp bow, a clamping spindle mounted in the spindle nut and a support arranged at the other end of the clamp bow, which can be used in conjunction with auxiliary elements for clamping a workpiece, it is proposed that the clamp bow have a guide section with guide surfaces for guiding infinitely adjustable, auxiliary elements for the C-shaped clamp.

18 Claims, 5 Drawing Sheets

C-SHAPED CLAMP

The invention relates to a C-shaped clamp for clamping workpieces comprising a C-shaped clamp bow, a spindle nut arranged at one end of the clamp bow, a clamping spindle mounted in the spindle nut and a support arranged at the other end of the clamp bow.

C-shaped clamps of this type are known from the state of the art. These clamps are always used such that they are utilized individually and without additional or auxiliary elements for the clamping of a workpiece.

The object underlying the invention is, therefore, to provide a C-shaped clamp which can be used for the clamping of a workpiece in conjunction with auxiliary elements.

This object is accomplished according to the invention, in a clamp of the type described at the outset, by the clamp bow having a guide section with guide surfaces for guiding auxiliary elements for the C-shaped clamp which are infinitely adjustable.

The provision of a guide section on the clamp bow creates the possibility of also utilizing auxiliary elements for a C-clamp and, in particular, of guiding these auxiliary elements on the guide section and thereby attaining a precise alignment of the auxiliary elements relative to the clamp bow.

The clamp bow is preferably designed in the inventive solution such that it has an arm bearing the spindle nut and an arm bearing the support, these arms adjoining the guide section on opposite sides so that the guide section is located in the middle between the two arms. In principle, the guide section could also be curved, for example arc-shaped. However, it is particularly advantageous for the guide section to extend in a straight line since, in this case, it is possible to move the auxiliary elements infinitely in parallel alignment relative to one another on the guide section.

It is possible to achieve a good guidance on the guide section when the guide section has two first guide surfaces which are parallel in one direction and located opposite one another.

This guidance is even better when the guide section has at least one second guide surface extending transversely to the first guide surfaces, the most advantageous solution likewise providing for two second guide surfaces.

In a solution which is advantageous even when extreme soiling is experienced during use, each of the first guide surfaces is divided into two part surfaces by a recess since dirt can collect in this recess in the case of extreme soiling during use and can therefore be borne away from the guide surfaces.

In the same way, it is advantageous for the second guide surface or the second guide surfaces to be divided into two part surfaces by a recess.

In principle, the clamp bow could be produced from forged or cast material, in which case the guide surfaces would, however, make it necessary for this material to be processed which is relatively costly. For this reason, in an embodiment which is inexpensive to produce and particularly advantageous, the guide section comprises drawn profile material not subject to subsequent processing or reworking.

With respect to the precision of the guide surfaces and the stability, particularly advantageous conditions can be achieved when the guide section is produced from a cold-drawn profile material.

From the point of view of production techniques, it is even more advantageous for the entire clamp bow to be produced from a cold-drawn profile material.

Furthermore, the stability of the guide section or of the clamp bow can be improved when the cold-drawn profile material is a heat-treatable steel.

In an additional embodiment improved with respect to its manufacture, the support is integrally formed onto the cold-drawn profile material.

With respect to the spindle nut, it is advantageous for this to be integrally formed onto the cold-drawn profile material.

The most varied of auxiliary elements can be arranged on the guide section for infinite displacement or adjustment. In one embodiment, a surface clamping element is guided on the guide section.

This surface clamping element is preferably designed such that it has a guide opening which is guided on the first guide surfaces so that a precise alignment of the surface clamping element is provided by the guide surfaces of the guide section.

It is even more advantageous for the surface clamping element to be guided with the guide opening on the second guide surface.

The surface clamping element is, in order to make a larger support surface available during clamping, a pure intermediate part which is preferably acted upon by the clamping spindle, in particular a clamping plate thereof.

Within the scope of the inventive solution, other auxiliary elements are, however, also conceivable. For example, in a particularly advantageous embodiment, a holder for the C-shaped clamp is placeable on the guide section.

With this holder it is possible, for example, to attach the C-shaped clamp to additional parts; for example, a holder of this type would be suitable for fixing the C-clamp in position in other clamping devices.

In an advantageous embodiment, the holder has a holder member embracing the guide section, this holder member being displaceable on the guide section and, preferably, infinitely positionable.

In a particularly advantageous version of an inventive holder designed as an auxiliary element, the holder has two identical holder members and two C-shaped clamps can be connected with the holder to form a clamping unit.

In order to be able to advantageously employ such a clamping unit, it is expedient for the holder members and, therefore, the two C-shaped clamps, as well, to be rotatable relative to one another.

Preferably, the holder members are rotatably held on one another such that the two C-shaped clamps have clamp planes extending parallel to the axis of rotation.

Alternatively, it is advantageous for the holder members to be held on one another such that one of the C-shaped clamps has a clamp plane extending parallel to the axis of rotation and the other of the C-shaped clamps a clamp plane extending at right angles to the axis of rotation.

For this purpose, the holder members are designed, for example, such that they can be flexibly combined with one another, for example via a linch pin.

In the simplest case, the holder members are designed such that they have two bores extending at right angles to one another for receiving the linch pin and so they can be combined with one another in the most varied of ways.

Additional features and advantages of the invention are the subject matter of the following description as well as the drawings of several embodiments.

Figure 1:
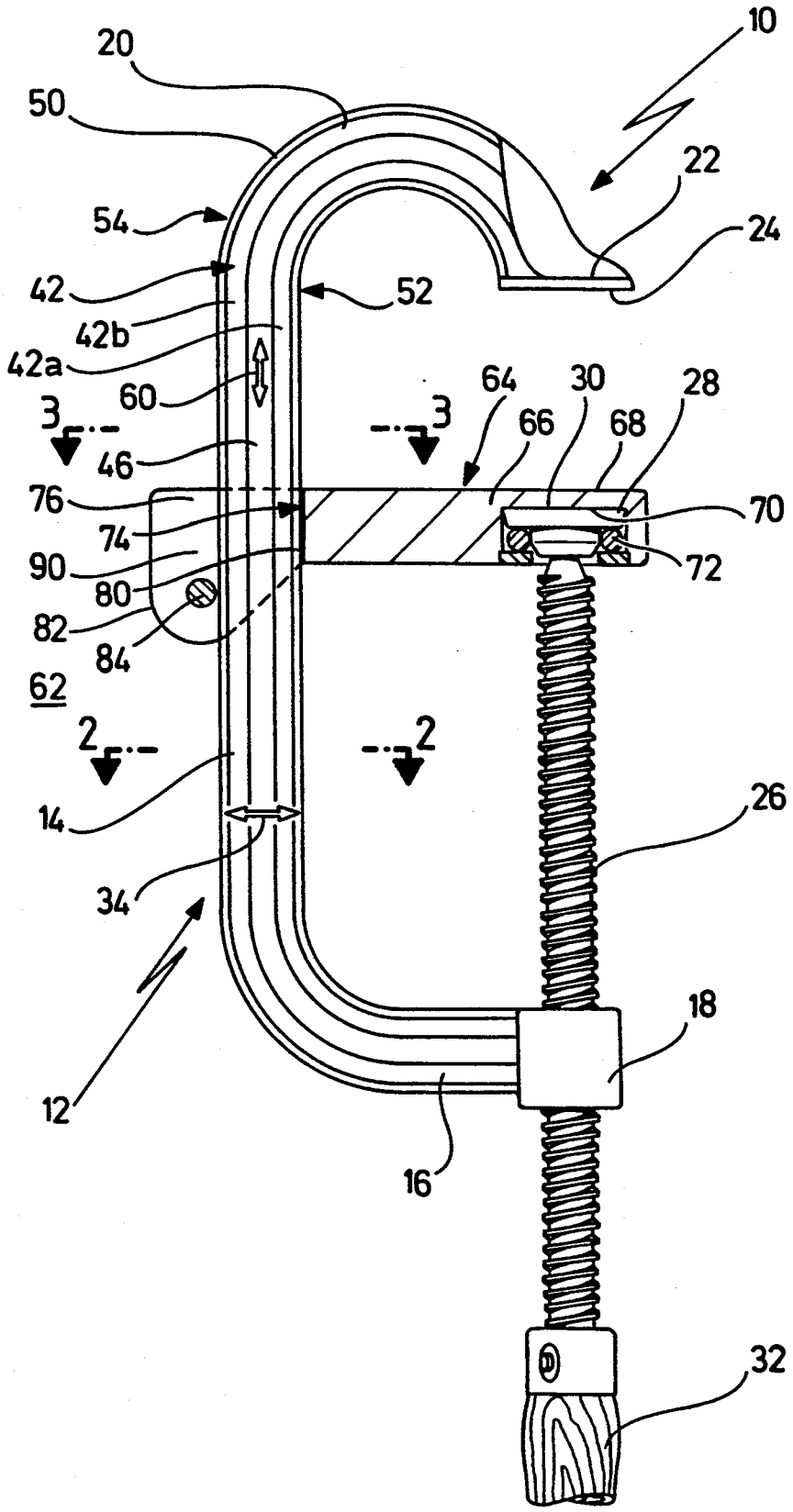
FIG. 1 is a plan view onto an inventive C-shaped clamp.

One embodiment of a C-shaped clamp, designated in FIG. 1 as a whole as 10, comprises a C-shaped clamp bow designated as a whole as 12, which comprises a guide section 14, an arm 16 which is integrally formed at one end of the guide section 14 and is designed as a spindle nut 18 at its end opposite the guide section, as well as an arm 20 which is integrally formed at the opposite end of the guide section 14, is designed as a support 22 at its end opposite the guide section 14 and has a clamping surface 24.

A clamping spindle designated as a whole as 26 is mounted in the spindle nut 18 and bears at its forward end a clamping plate 28 which is rotatably mounted thereon and has a clamping plate surface 30. A workpiece can therefore be clamped between the clamping plate surface 30 and the clamping surface 24 by tightening the spindle nut 18.

For actuating the spindle nut 18, this is preferably provided with a rotatable handle 32.

In the inventive embodiment, the clamp bow 12, comprising the arms 16 and 20 as well as the guide section 14, is produced from a cold-drawn profile material which is additionally heat-treated or hardened and tempered and the support 22 is integrally formed onto this profile material whereas the spindle nut 18 is welded to the arm 16 bearing it.

Figure 2:
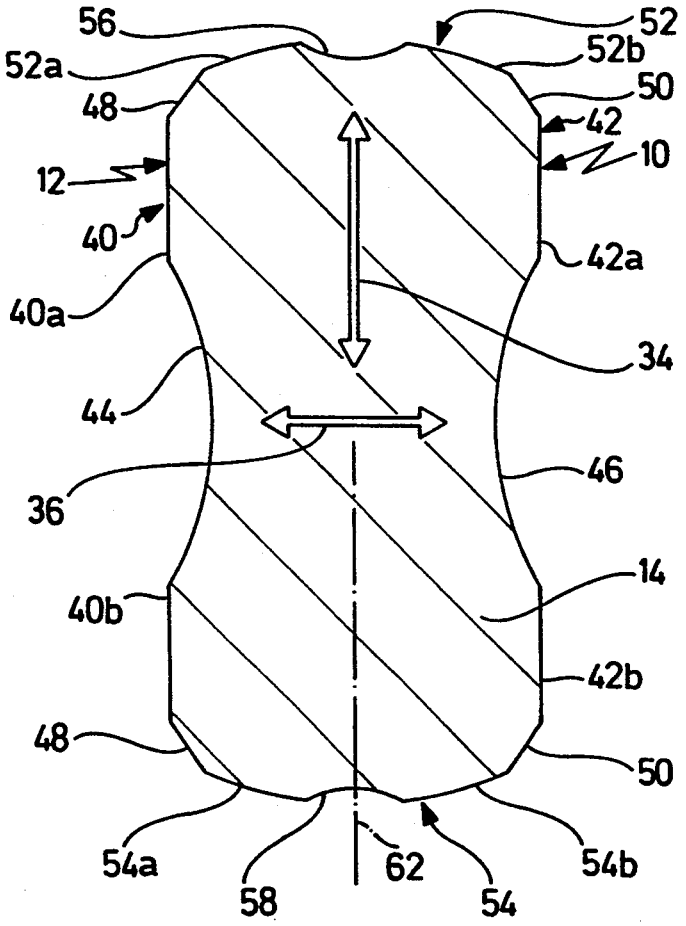
FIG. 2 is a section along line 2—2 in FIG. 1.
Figure 3:
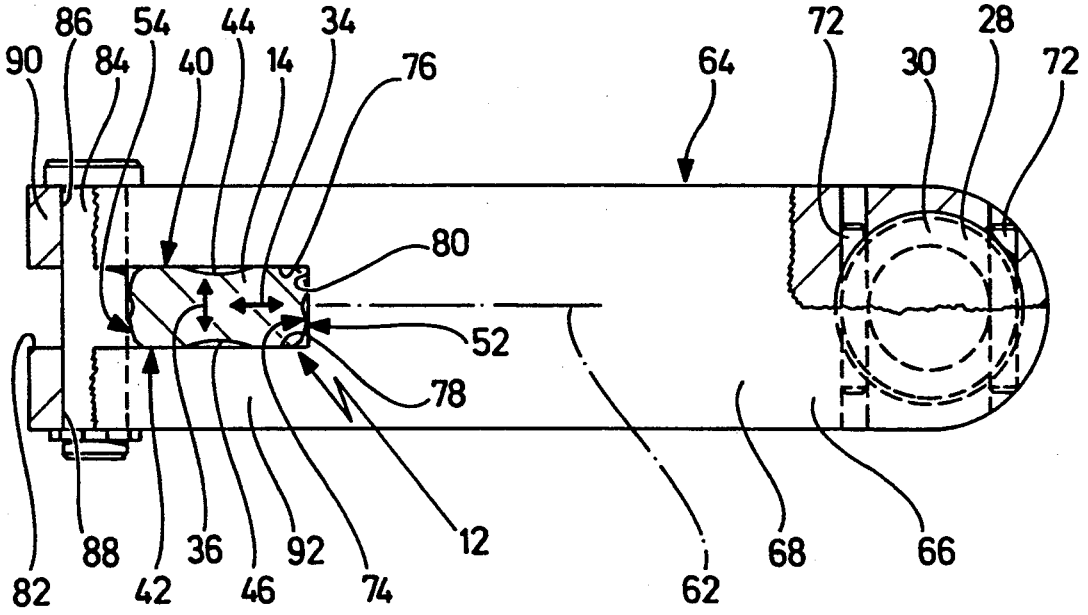
FIG. 3 is a section along line 3—3 in FIG. 1.

The profile material forming the clamp bow 12 has, as illustrated in FIG. 2, an elongated cross section in the direction of its height 34 and a cross section having a smaller extension in the direction of its breadth 36 and forms two first guide surfaces 40 and 42 which extend approximately parallel to the height 34. These guide surfaces extend parallel to one another and are located on opposite sides of the clamp bow 12. These first guide surfaces 40 and 42 are each subdivided into two part surfaces **40*a* and 40*b* and 42*a* and 42*b*, respectively, and separated each time by a recess 44 and 46, respectively, the part surfaces 40*a* and 40*b* as well as 42*a* and 42*b*** being located each time in a common plane.

The sides of the first guide surfaces 40 and 42 located opposite the recesses 44 and 46, respectively, are followed by inclined edges 48 and 50, respectively, and these in turn are followed by a curved second guide surface 52 and 54, respectively, which is also divided into two part surfaces **52*a* and 52*b* as well as 54*a* and 54*b* by a recess 56 and 58**, respectively.

The recesses 44 and 46 as well as 56 and 58 serve to accommodate dirt accumulating in the region of the guide surfaces 40 and 42 or 52 and 54, respectively, when an auxiliary element is slidingly movable on these guide surfaces 40 and 42 as well as 52 and 54.

The guide section 14 is preferably designed to be in a straight line and extends with its longitudinal direction 60 in the same plane as the arms 16 and 20 of the clamp bow 12 which is therefore located in a clamp plane 62 which is identical to the plane of drawing in FIG. 1.

As an example of an auxiliary element, a surface clamping element 64 is provided in FIG. 1. This element has a clamping body 66 which has a clamping body surface 68 on its side facing the clamping surface 24. This clamping body surface extends essentially from the guide section 14 up to and beyond the clamping plate surface 30 and is located in a plane parallel to the clamping surface 24. The clamping body 66 is provided on its rear side with a contact surface 70, on which the clamping plate surface 30 abuts for acting on the surface clamping element 64. In addition, the clamping plate 28 is fixed in position by two locating pins 72 which engage behind the clamping plate 28 on its rear side opposite the clamping plate surface 30.

The surface clamping element 64 is guided by a guide opening 74, through which the guide section 14 of the clamp bow 12 extends. This guide opening 74 abuts with its two side walls 76 and 78 on the first guide surfaces 40 and 42, respectively, and with its cross wall 80 on the second guide surface 52.

In order to place the surface clamping element 64 on the guide section 14, the guide opening 74 is U-shaped in design and provided with an aperture 82.

For additionally fixing the surface clamping element 64 in position, a locating bolt 84 is provided which penetrates the surface clamping element parallel to the breadth 36 of the guide section 14 and abuts on the second guide surface 54 so that the surface clamping element 64 encircles the guide section 14 on all sides and is guided thereon in a positive locking manner with an alignment of the clamping body surface 68 essentially parallel to the clamping surface 24.

Preferably, the locating bolt is releasably secured to the surface clamping element 64 and penetrates two bores 86 and 88 in lower arms 90 and 92 of the surface clamping element 64 which enclose the guide opening 74 between them.

Moreover, the lower arms 90 and 92 are designed to spring back in the opposite direction relative to the clamping body surface 68 so that the locating bolt 84 is arranged in the longitudinal direction 60 of the guide section in the section of the cross wall 80 of the guide opening 74. This results in easier displaceability of the surface clamping element 64 on the guide section 14.

Figure 4:
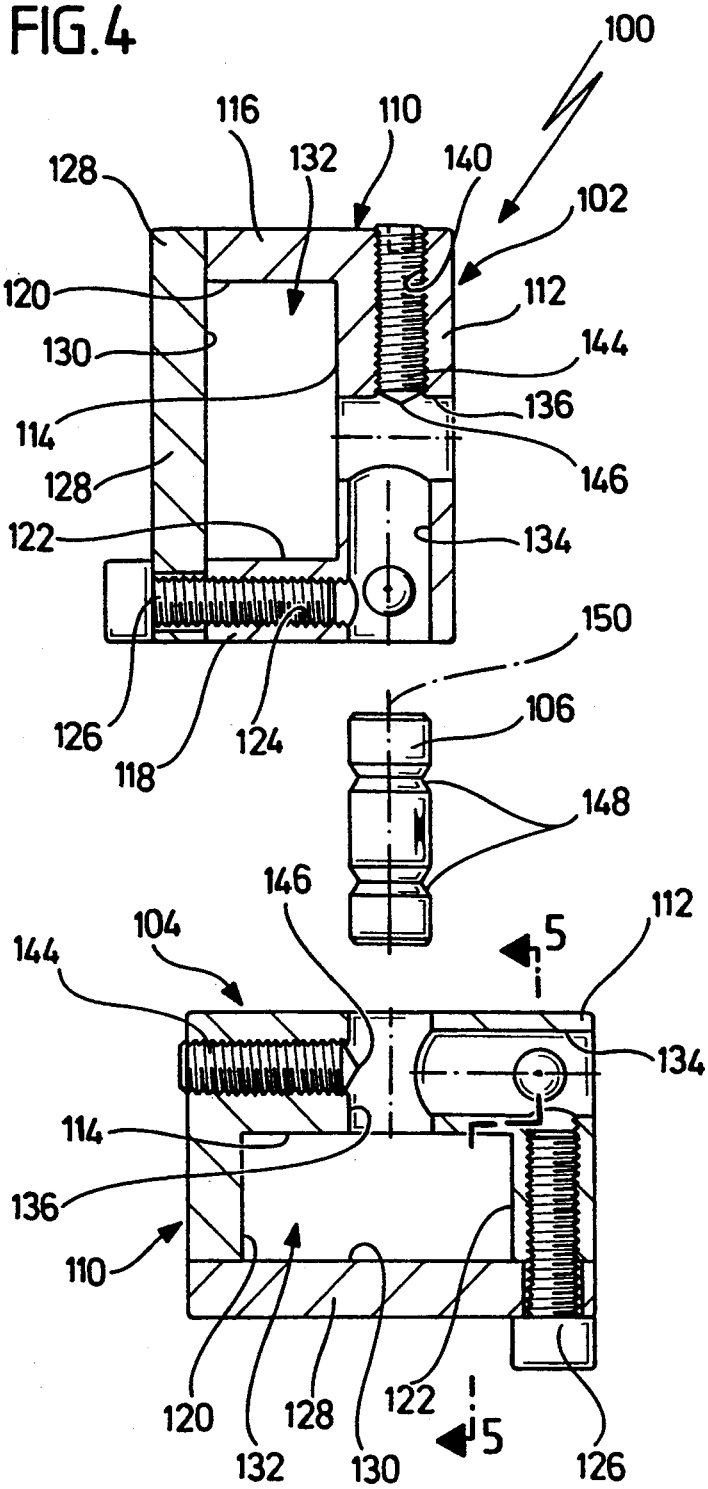
FIG. 4 is an exploded illustration of an inventive holder.
Figure 5:
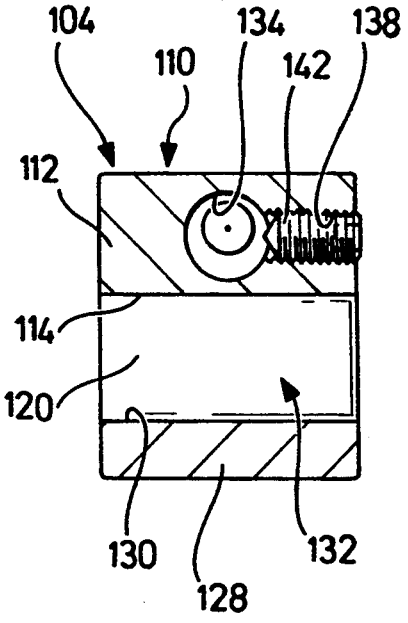
FIG. 5 is a section along line 5—5 in FIG. 4.

A second embodiment of an auxiliary element, illustrated in FIGS. 4 and 5, comprises a holder which is designated as a whole as 100 and has two holder members 102 and 104 which are of identical design. These two holder members 102 and 104 can be connected with one another via a connecting bolt 106. Each of these holder members 102 and 104 comprises a basic body 110, which is U-shaped in design and has a base part 112 which bears a contact surface 114 and from which two side parts 116 and 118 extend parallel to one another on both sides of the contact surface 114 and away therefrom. The side parts 116 and 118 each bear side contact surfaces 120 and 122 which face one another and extend parallel to one another. One of the side parts 118 is provided with a threaded bore 124, into which a screw 126 engages for fixing a cover part 128 in place so as to rest on the two side parts 116 and 118. This cover part is, for its part, provided with a contact surface 130 which is located opposite the contact surface 114 so that the holder member 104 forms with the base part 112, the side parts 116 and 118 as well as the cover part 128 an altogether rectangular recess 132, with which this holder member 102 or 104 is guided on the guide section 14 when placed on the guide section 14 and can be secured in place at any point on the guide section 14 by clamping this between the contact surfaces 114 and 130.

Furthermore, the base part 112 is provided with a bore 134 extending parallel to the contact surface 114 and a bore 136 extending at right angles to the contact surface 114, into which the connecting bolt can be inserted. Each of these bores 134 and 136 has a threaded bore 138 and 140, respectively, extending transversely thereto. A setscrew 142 and 144, respectively, can be screwed into each of these bores and with its tip 146 can be brought into engagement with a circumferential groove 148 in the connecting bolt 106 in order to fix the connecting bolt 106 in position in the respective bore 134 or 136 so as to be axially non-displaceable but rotatable or non-rotatable by force-locking connection. An axis 150 of the connecting bolt forms the axis of rotation in the case of the rotatable connection.

Figure 6:
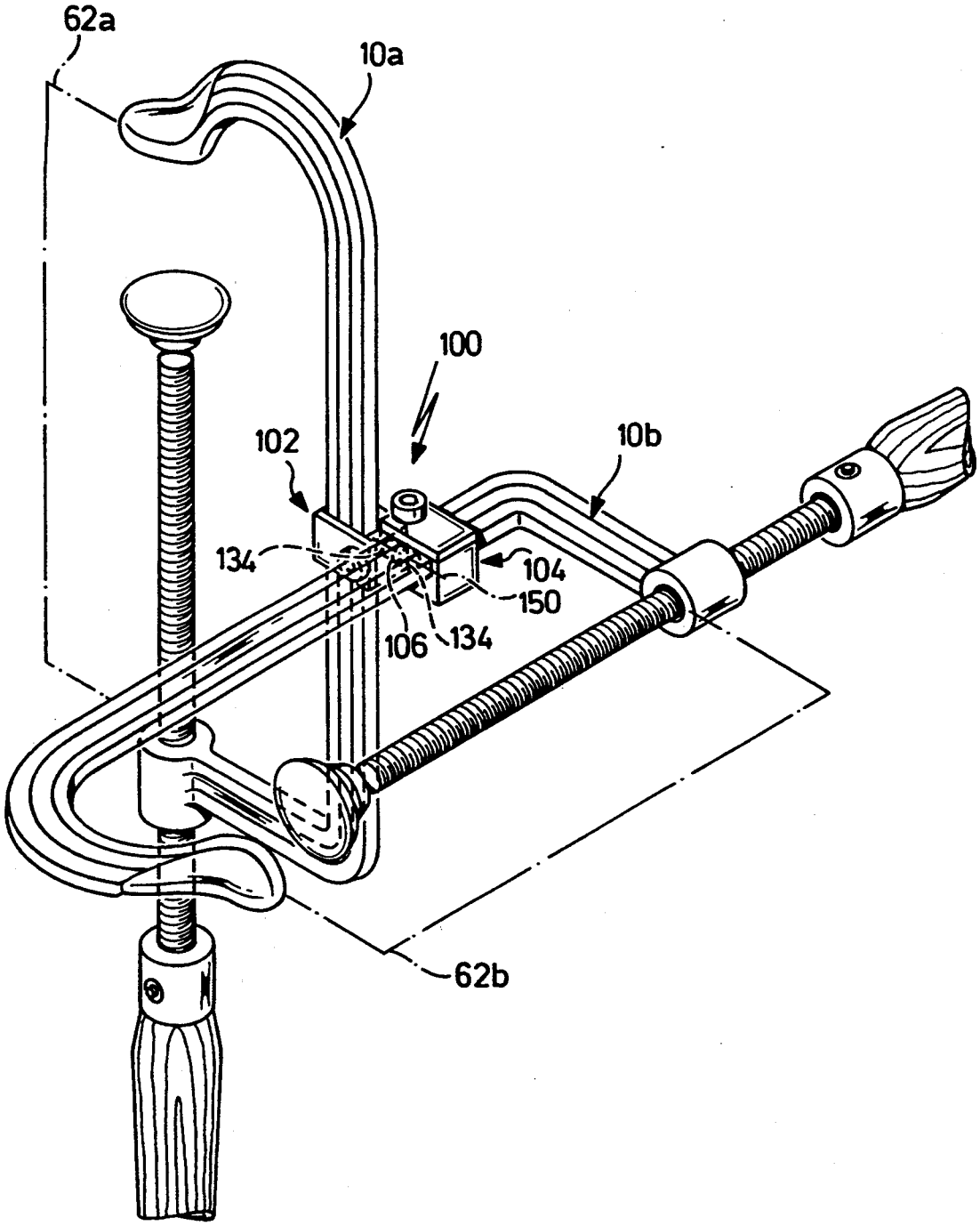
FIG. 6 is a first form of an inventive clamping unit.

If the connecting bolt 106 is inserted into the bore 134 in each of the holder members 102 and 104 and fixed in position therein by means of the screw 142 so as to be axially non-displaceable, the two C-shaped clamps 10*a* and 10*b*, as illustrated in FIG. 6, are fixed in position relative to one another such that their clamp planes 62*a* and 62*b* each extend through the axis of rotation 150.

Figure 7:
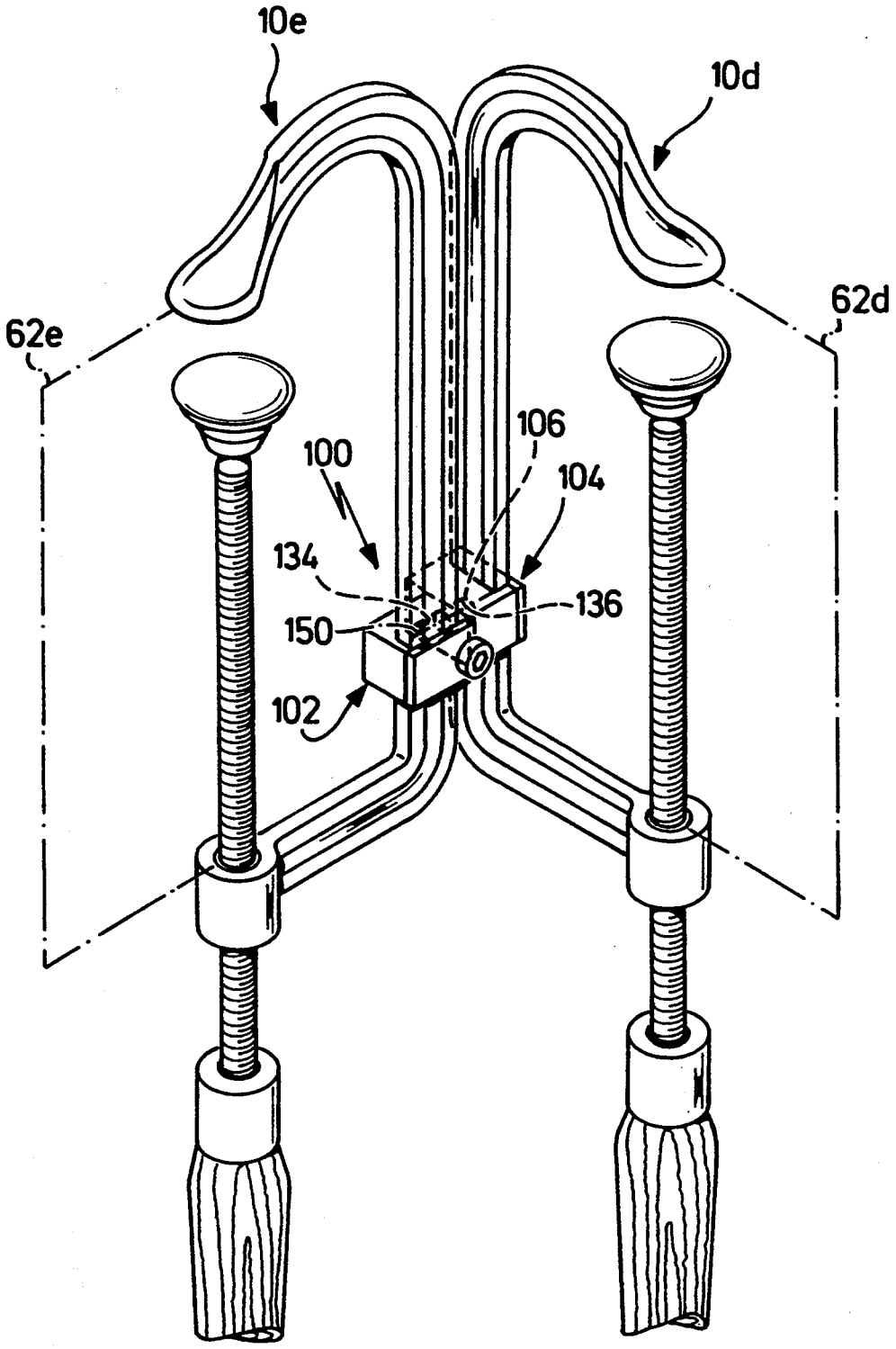
FIG. 7 is a second form of an inventive clamping unit.

If, on the other hand, the connecting bolt 106, as indicated in the exploded illustration of FIG. 4, is fixed in position on the one hand in the bore 136 in the holder member 104 and on the other hand in the bore 134 in the holder member 102, the two C-shaped clamps 10*d* and 10*e*, as illustrated in FIG. 7, are aligned relative to one another such that the clamp plane 62*d* extends parallel to the axis of rotation 150 and the clamp plane 62*e* at right angles to the axis of rotation 150.

The present disclosure relates to the subject matter disclosed in German application No. P 42 36 049.8 of Oct. 24, 1992, the entire specification of which is incorporated herein by reference.

What is claimed is:

1. A C-shaped clamp for clamping workpieces comprising:

a C-shaped clamp bow having first and second ends and made entirely of a cold drawn profile material;

a spindle nut arranged at the first end of the clamp bow;

a clamping spindle mounted in the spindle nut;

a support immovably arranged at the second end of the clamp bow;

a guide section arranged between said first and second ends, said guide section having guide surfaces for guiding adjustable auxiliary elements for said C-shaped clamp and being adapted to receive a holder for the C-shaped clamp;

said holder having a holder member for embracing the guide; and said guide section comprising said cold drawn profile material with said guide surfaces being formed therein by drawing without further mechanical processing or reworking.

2. A clamp as defined in claim 1, wherein the clamp bow has an arm bearing the spindle nut and an arm bearing the support, said arms adjoining the guide section on opposite sides.

3. A clamp as defined in claim 1, wherein the guide section extends in a straight line.

4. A clamp as defined in claim 1, wherein the guide section has two first guide surfaces parallel in one direction and located opposite one another.

5. A clamp as defined in claim 4, wherein the guide section has at least one second guide surface extending transversely to the first guide surfaces.

6. A clamp as defined in claim 4, wherein each of the first guide surfaces is divided into two part surfaces by a recess.

7. A clamp as defined in claim 5, wherein the second guide surface is divided into two part surfaces by a recess.

8. A clamp as defined in claim 1, wherein the cold-drawn profile material is additionally heat treated.

9. A clamp as defined in claim 1, wherein the cold-drawn profile material is additionally hardened and tempered.

10. A clamp as defined in claim 1, wherein the support is integrally formed onto the cold-drawn profile material.

11. A clamp as defined in claim 5, wherein a surface clamping element is guided on the guide section.

12. A clamp as defined in claim 11, wherein the surface clamping element has a guide opening guided on the first guide surfaces.

13. A clamp as defined in claim 12, wherein the guide opening is guided on the second guide surface.

14. A clamp as defined in claim 1, wherein a surface clamping element is guided on the guide section and is acted upon by the clamping spindle.

15. A C-shaped clamp for clamping workpieces comprising:

a C-shaped clamp bow having first and second ends;

a spindle nut arranged at the first end of said clamp bow for holding a clamping spindle;

a support arranged at the second end of the clamp bow; and a guide section arranged between said first and second ends, said guide section having guide surfaces for guiding an adjustable holder mounted on said guide section, said holder having a first holder member for holding said C-shaped clamp and a second holder member for holding another C-shaped clamp;

wherein said C-shaped clamps are connectable together via the holder to form a clamping unit.

16. A clamp in accordance with claim 15 wherein said first and second holder members are rotatable relative to one another.

17. A clamp in accordance with claim 16 wherein said holder members hold the C-shaped clamps with their clamp planes parallel to the axis of rotation of said first and second holder members.

18. A clamp in accordance with claim 16 wherein said holder members hold the C-shaped clamps relative to one another such that one clamp plane is aligned parallel to and the other clamp plane is aligned perpendicular to the axis of rotation of said first and second holder members.

* * * * *